US007585427B2

(12) United States Patent
Yamakita et al.

(10) Patent No.: US 7,585,427 B2
(45) **Date of Patent: *Sep. 8, 2009**

(54) PROCESSING AGENTS AND METHODS FOR SYNTHETIC FIBERS

(75) Inventors: Hiroshi Yamakita, Gamagori (JP); Atsushi Toda, Gamagori (JP)

(73) Assignee: Takemoto Yushi Kabushiki Kaisha, Aichi (JP)

( * ) Notice: Subject to any disclaimer, the term of this patent is extended or adjusted under 35 U.S.C. 154(b) by 796 days.

This patent is subject to a terminal disclaimer.

(21) Appl. No.: 11/261,209

(22) Filed: Oct. 27, 2005

(65) Prior Publication Data

US 2006/0093747 A1 May 4, 2006

(30) Foreign Application Priority Data

Nov. 2, 2004 (JP) ..... 2004-319141
Aug. 22, 2005 (JP) ..... 2005-239278

(51) Int. Cl.
*D06M 11/00* (2006.01)

(52) U.S. Cl. ..... 252/8.81; 8/115.51; 8/115.6; 8/115.54; 8/115.62; 252/8.83; 252/8.84; 427/389.9; 427/394

(58) Field of Classification Search ..... 8/115.51, 8/115.6, 115.54, 115.62; 252/8.81, 8.83, 252/8.84; 427/389.9, 394
See application file for complete search history.

(56) References Cited

U.S. PATENT DOCUMENTS

| | | | | | |
|---|---|---|---|---|---|
| 4,561,987 | A * | 12/1985 | Yamamoto et al. | ..... | 252/8.84 |
| 5,061,384 | A * | 10/1991 | Suzuki et al. | ..... | 252/8.84 |
| 6,143,038 | A * | 11/2000 | Yamamoto et al. | ..... | 8/115.6 |
| 6,200,492 | B1 * | 3/2001 | Eicken et al. | ..... | 252/8.81 |
| 6,432,144 | B1 * | 8/2002 | Sakuraba et al. | ..... | 8/115.51 |
| 6,730,130 | B2 * | 5/2004 | Sakuraba et al. | ..... | 8/115.51 |
| 7,208,017 | B2 * | 4/2007 | Yamakita et al. | ..... | 8/115.6 |
| 7,351,350 | B2 * | 4/2008 | Aratani | ..... | 252/8.61 |
| 7,416,678 | B2 * | 8/2008 | Aratani | ..... | 252/8.61 |
| 2002/0161123 | A1 * | 10/2002 | Li et al. | ..... | 525/178 |

FOREIGN PATENT DOCUMENTS

| | | | |
|---|---|---|---|
| EP | 1 052 325 | | 5/2006 |
| JP | 60-009971 | A * | 1/1985 |
| JP | 60-181368 | A * | 9/1985 |
| JP | 02-047372 | A * | 1/1990 |
| JP | 02-269878 | | 5/1990 |
| JP | 03-097961 | A * | 4/1991 |
| JP | 06-207379 | A * | 7/1994 |
| JP | 2000-136448 | A * | 5/2000 |

* cited by examiner

*Primary Examiner*—Anthony J Green
(74) *Attorney, Agent, or Firm*—Weaver Austin Villeneuve & Sampson LLP

(57) ABSTRACT

A processing agent for synthetic fibers contains four specified kinds of components (Components A, B, C and D) each by a specified amount and also by a specified total amount so as to have improved characteristics of preventing occurrence of fluffs. yard breaking and uneven dyeing when applied to synthetic fibers at a specified rate.

17 Claims, No Drawings

PROCESSING AGENTS AND METHODS FOR SYNTHETIC FIBERS

Priority is claimed on Japanese Patent Applications 2004-319141 filed Nov. 2, 2004 and 2005-239278 filed Aug. 22, 2005.

BACKGROUND OF THE INVENTION

This invention relates to agents for the processing of synthetic fibers and methods of processing synthetic fibers.

With the recent increase in the speed of spinning and fabrication processes for synthetic fibers, occurrence of fluffs and breaking in produced yarns, as well as dyeing specks on textiles is becoming even more frequent. In order to prevent such occurrence of fluffs, yarn breaking and dyeing specks, it has been known to increase the content of a functional improvement agent serving as a processing agent for the synthetic fibers to be applied thereto or to increase the amount of such a processing agent to be applied but such prior art attempts have not be sufficiently successful in view of the recent increase in the speed. It is therefore an object of this invention to provide improved processing agents and methods for synthetic fibers capable of sufficiently preventing the occurrence of fluffs, yarn breaking and dyeing specks in response to the recent increase in the production and processing speed.

It has been known to use processing agents containing a lubricant and a functional improvement agent for synthetic fibers. Known examples of processing agents containing a functional improvement agent for preventing the occurrence of fluffs and yarn breaking include those described in Japanese Patent Publications Tokkai 60-9971, 1-298281, 2-47372, 60-181368, 2000-136448, 3-97961 and 6-207379 and U.S. Pat. No. 6,432,144B1. These processing agents are not sufficiently capable of preventing the occurrence of fluffs, yarn breaking and dyeing specks in view of the requirement of the recent years due to increased processing speed.

SUMMARY OF THE INVENTION

It is therefore an object of this invention to provide processing agents and methods capable of sufficiently successfully prevent the occurrence of fluffs, yarn breaking and dyeing specks corresponding to the recent increase in the speed in the spinning and fabrication processes for synthetic fibers.

The present invention is based on the discovery by the present inventors, as a result of their studies in view of the object described above, that use should be made of a processing agent containing four specified components at specified ratios and that a specified amount of such an agent should be applied to the synthetic fibers.

DETAILED DESCRIPTION OF THE INVENTION

The invention firstly relates to a processing agent for synthetic fibers characterized as containing by 70 weight % or more a base oil composition which is comprised of Component A, Component B, Component C and Component D as defined below, containing Component A by 50-90% by weight, Component B by 3-30% by weight, Component C by 0.1-10% by weight and Component D by 0.1-20% by weight such that Components A, B, C and D are together contained by 100% by weight. In the above, Component A is one or more selected from alkyleneoxide addition compounds simultaneously satisfying Conditions 1, 2 and 3 wherein Condition 1 is the condition of having a number average molecular weight of 1000-12000 and being obtainable by adding alkylene oxide with 2-4 carbon atoms to monohydric-trihydric aliphatic alcohol with 1-24 carbon atoms, Condition 2 is the condition of having polyoxyalkylene groups comprising oxyalkylene units of which 10-80% by weight are oxyethylene units, and Condition 3 is the condition of containing 35% by weight or more of alkyleneoxide addition compounds obtainable by adding ethylene oxide and propylene oxide to monohydric aliphatic alcohol with 6-10 carbon atoms; Component B is one or more selected from alkylene oxide addition compounds with number average molecular weight of 140-800 having ethylene oxide or both ethylene oxide and propylene oxide to monohydric aliphatic alcohol with 6-10 carbon atoms, having polyoxyalkylene group of which more than 30% by weight of all constituent oxyalkylene units are oxyethylene units; Component C is one or more selected from ionic surfactants; and Component D is one or more selected from the group consisting of nonionic surfactants having ether bond (hereinafter also referred to as ether type nonionic surfactants) with number average molecular weight of 210-950 having ethylene oxide and propylene oxide added to monohydric aliphatic alcohol with 11-24 carbon atoms, nonionic surfactants with number average molecular weight of 900-2000 having ethylene oxide or propylene oxide added to monohydric aliphatic alcohol with 6-10 carbon atoms, ether type nonionic surfactants with number average molecular weight of 150-2500 having ethylene oxide or propylene oxide added to monohydric aliphatic alcohol with 11-24 carbon atoms, nonionic surfactants having ether bond (hereinafter also referred to as ether type nonionic surfactants) with number average molecular weight of 200-2000 having ethylene oxide and/or propylene oxide added to monohydric aliphatic acid with 8-24 carbon atoms, nonionic surfactants with number average molecular weight of 700-10000 having ethylene oxide and/or propylene oxide added to animal oils and vegetable oils, nonionic surfactants having aminoether bond (hereinafter also referred to as aminoether type nonionic surfactants) with number average molecular weight of 200-2500 having ethylene oxide and/or propylene oxide added to aliphatic amine with 8-24 carbon atoms, nonionic surfactants having aminoether bond (hereinafter also referred to as aminoether type nonionic surfactants) with number average molecular weight of 250-2500 having ethylene oxide and/or propylene oxide added to aliphatic amide with 8-24 carbon atoms, nonionic surfactants having partial ester bond (hereinafter also referred to as partial ester type nonionic surfactants)and having dihydric-hexahydric aliphatic alcohol with 2-6 carbon atoms partially esterified with aliphatic acid with 8-24 carbon atoms, and ether-ester nonionic surfactants with number average molecular weight of 400-6000 having ethylene oxide and/or propylene oxide added to partial ester having trihydric-hexahydric aliphatic alcohol with 3-6 carbon atoms partially esterified with aliphatic acid with 8-24 carbon atoms. For the convenience of description, expression "weight %" may hereinafter be employed as meaning "% by weight", as commonly done by persons skilled in the relevant arts.

The invention also relates to a method of processing synthetic fibers characterized by the step of applying a processing agent for synthetic fibers according to this invention to synthetic fibers at a rate of 0.1-3 weight % with respect to the synthetic fibers.

The processing agent for synthetic fibers according to this invention (hereinafter referred to simply as the processing agent of this invention) will be explained next more in detail. As explained summarily above, the processing agent of this invention is characterized as containing a base oil composition which is comprised of Component A, Component B, Component C and Component D, and Component A is one or more selected from alkyleneoxide addition compounds which simultaneously satisfy three specified conditions (Conditions 1-3).

Condition 1 on Component A is a requirement that the alkyleneoxide addition compounds, of which Component A is one or more, should have a number average molecular weight of 1000-12000 and be obtainable by adding alkylene oxide with 2-4 carbon atoms to monohydric-trihydric aliphatic alcohol with 1-24 carbon atoms. Examples of such monohydric-trihydric aliphatic alcohol with 1-24 carbon atoms include (1) monohydric straight-chain saturated aliphatic alcohols such as methyl alcohol, ethyl alcohol, propyl alcohol, butyl alcohol, pentyl alcohol, hexyl alcohol, heptyl alcohol, octyl alcohol, nonyl alcohol, decyl alcohol, undecyl alcohol, dodecyl alcohol, tridecyl alcohol, tetradecyl alcohol, pentadecyl alcohol, hexadecyl alcohol, heptadecyl alcohol, octadecyl alcohol, nonadecyl alcohol, eicosyl alcohol, heneicosyl alcohol, docosyl alcohol, tricosyl alcohol and tetracosyl alcohol; (2) monohydric branched saturated aliphatic alcohols such as isopropyl alcohol, isobutyl alcohol, isopentyl alcohol, 2-methyl-pentyl alcohol, 2-ethyl-hexyl alcohol, 2-propyl-heptyl alcohol, 2-butyl-octyl alcohol, 2-pentyl-nonyl alcohol, 2-hexyl-decyl alcohol, 2-heptyl-undecyl alcohol, 2-octyl-dodecyl alcohol, 2-nonyl-tridecyl alcohol, 2-decyl-tetradecyl alcohol, 2-undecyl-pentadecyl alcohol and 2-dodecyl-hexadecyl alcohol; (3) monohydric straight-chain unsaturated aliphatic alcohols such as 10-undecenyl alcohol, 9c-tetradecenyl alcohol, 9c-hexadecenyl alcohol, 9c-octadecenyl alcohol, 9t-octadecenyl alcohol, 9c,12c-octadecadienyl alcohol, 9c,12c,15c-octadecatrienyl alcohol, 9c-eicosenyl alcohol, 5,8,11,14-eicosatetraenyl alcohol, 13c-docosenyl alcohol and 13t-docosenyl alcohol; (4) dihydric aliphatic alcohols such as ethylene glycol, 1,2-propane diol, 1,3-propane diol, 1,4-butane diol, 1,6-hexane diol and neopentyl glycol; and (5) trihydric aliphatic alcohols such as glycerol and trimethylol propane.

Examples of alkylene oxide with 2-4 carbon atoms in Condition 1 include ethylene oxide, propylene oxide, 1,2-butylene oxide and 1,4-butylene oxide but ethylene oxide and propylene oxide are preferred. These alkylene oxides may be used singly or as a mixture. If they are used as a mixture, the form of addition of alkylene oxides to monohydric-trihydric aliphatic alcohol with 1-24 carbon atoms may be random addition, block addition or random-block addition.

The number average molecular weight of alkyleneoxide addition compounds satisfying Condition 1 as described above is in the range of 1000-12000, and preferably 1000-10000.

Condition 2 on Component A is a requirement that the alkyleneoxide addition compounds should have polyoxyalkylene groups comprising oxyalkylene units of which 10-80 weight % are oxyethylene units.

Condition 3 on Component A is a requirement of containing 35 weight % or more of alkyleneoxide addition compounds obtained by adding ethylene oxide and propylene oxide to monohydric aliphatic alcohol with 6-10 carbon atoms. Examples of such monohydric aliphatic alcohol with 6-10 carbon atoms include (1) straight-chain saturated aliphatic alcohols such as hexyl alcohol, heptyl alcohol, octyl alcohol, nonyl alcohol and decyl alcohol; and (2) branched saturated aliphatic alcohols such as 2-methyl-pentyl alcohol, 2-ethyl-hexyl alcohol and 2-propyl-heptyl alcohol.

Component A is one or more selected from alkyleneoxide addition compounds simultaneously satisfying aforementioned Conditions 1, 2 and 3 but those containing Component E and Component F described below by a total amount of 50 weight % or more at a weight ratio of 50/50-90/10 are preferred, where Component E is an alkyleneoxide addition compound with number average molecular weight of 1000-12000, obtainable by adding ethylene oxide and propylene oxide to monohydric aliphatic alcohol with 6-10 carbon atoms at a weight ratio of 35/65-80/20 and Component F is an alkyleneoxide addition compound with number average molecular weight of 1000-12000, obtainable by adding ethylene oxide and propylene oxide to monohydric aliphatic alcohol with 11-16 carbon atoms at a weight ratio of 10/90-80/20.

Examples of monohydric aliphatic alcohol with 6-10 carbon atoms for Component E include (1) straight-chain saturated aliphatic alcohols such as hexyl alcohol, heptyl alcohol, octyl alcohol, nonyl alcohol and decyl alcohol; and (2) branched saturated aliphatic alcohols such as 2-methyl-pentyl alcohol, 2-ethyl-hexyl alcohol and 2-propyl-heptyl alcohol.

Examples of monohydric aliphatic alcohol with 11-16 carbon atoms for Component F include undecyl alcohol, dodecyl alcohol, tridecyl alcohol, tetradecyl alcohol, pentadecyl alcohol, hexadecyl alcohol, 2-propyl-heptyl alcohol, 2-butyl-octyl alcohol, 2-pentyl-nonyl alcohol, 2-hexyl-decyl alcohol, 9c-tetradecenyl alcohol and 9c-hexadecenyl alcohol. Among these, however, those containing 70 molar % or more of straight-chain aliphatic alcohol such as dodecyl alcohol, tridecyl alcohol, tetradecyl alcohol, pentadecyl alcohol and hexadecyl alcohol are preferred.

These alkyleneoxide addition compounds serving as Component A themselves can be synthesized by a commonly known method such as the method of causing alkylene oxides with 2-4 carbon atoms to sequentially undergo addition reactions to aliphatic alcohol in the presence of an alkaline catalyst.

Component B is alkyleneoxide compound having ethylene oxide or ethylene oxide and propylene oxide added to monohydric aliphatic alcohol with 6-10 carbon atoms. Examples of monohydric aliphatic alcohol with 6-10 carbon atoms include (1) straight-chain saturated aliphatic alcohols such as hexyl alcohol, heptyl alcohol, octyl alcohol, nonyl alcohol and decyl alcohol; and (2) branched saturated aliphatic alcohols such as isooctyl alcohol, 2-methyl-pentyl alcohol, 2-ethyl-hexyl alcohol, 3,3,5-trimethyl-hexyl alcohol, 2-methyloctyl alcohol and 2-propyl-heptyl alcohol. The number average molecular weight of alkyleneoxide addition compound adducts as Component B is 140-800, and is more preferably 200-700. The ratio of oxyethylene units to all oxyalkylene units that form the polyoxyalkylene group of the alkyleneoxide adduct is 30 weight % or more, and is more preferably 50 weight % or more. There is no particular limitation on the form of addition of ethylene oxide and propylene oxide to aliphatic alcohol.

Component C is an ionic surfactant. Ionic surfactants of known kinds can be used for the purpose of this invention. Examples thereof include (1) anionic surfactant including organic salts of sulfonic acid such as sodium dodecyl benzene sulfonate, organic esters of sulfuric acid such as sodium laurylpoly(oxyethylene) sulfate, organic esters of phosphoric acid such as potassium polyoxylauryl phosphate and organic salts of aliphatic acid such as sodium oleate and potassium alkenyl succinate; (2) cationic surfactants quaternary ammonium salts such as lauryl trimethyl ammonium sulfate and 2-heptadecenyl-hydroxyethyl-imidazoline; and (3) amphoteric surfactants such as octyldimethyl ammonio acetate, lauryl amino propionate and lauryl amine oxide. Among these, anionic surfaces are preferred.

Component D is a specified kind of nonionic surfactant. Examples thereof include (1) ether type nonionic surfactants with number average molecular weight of 210-950 having ethylene oxide and propylene oxide added to monohydric aliphatic alcohol with 11-24 carbon atoms; (2) ether type nonionic surfactants with number average molecular weight of 900-2000 having ethylene oxide or propylene oxide added to monohydric aliphatic alcohol with 6-10 carbon atoms; (3) ether type nonionic surfactants with number average molecular weight of 150-2500 having ethylene oxide or propylene oxide added to monohydric aliphatic alcohol with 11-24 carbon atoms; (4) ester type nonionic surfactants with number average molecular weight of 200-2000 having ethylene oxide and/or propylene oxide added to monohydric aliphatic acid with 8-24 carbon atoms; (5) nonionic surfactants with number average molecular weight of 700-10000 having ethylene oxide and/or propylene oxide added to animal oils and/or vegetable oils; (6) aminoether type nonionic surfactants with number average molecular weight of 200-2500 having ethylene oxide and/or propylene oxide added to aliphatic amine with 8-24 carbon atoms; (7) amidoether type nonionic surfactants with number average molecular weight of 250-2500 having ethylene oxide and/or propylene oxide added to aliphatic amide with 8-24 carbon atoms; (8) partial ester type nonionic surfactants having dihydric-hexahydric aliphatic alcohol with 2-6 carbon atoms partially esterified with aliphatic acid with 8-24 carbon atoms; and (9) ether-ester nonionic surfactants with number average molecular weight of 400-6000 having ethylene oxide and/or propylene oxide added to partial ester having trihydric-hexahydric aliphatic alcohol with 3-6 carbon atoms partially esterified with aliphatic acid with 8-24 carbon atoms.

Examples of ether type nonionic surfactant with number average molecular weight of 210-950 having ethylene oxide and propylene oxide added to monohydric aliphatic alcohol with 11-24 carbon atoms, serving as Component D, include α-undecyl-ω-hydroxy-poly(oxyethylene)poly(oxypropylene), α-dodecyl-ω-hydroxy-poly(oxyethylene)poly(oxypropylene), α-tridecyl-ω-hydroxy-poly(oxyethylene)poly(oxypropylene), α-tetradecyl-ω-hydroxy-poly(oxyethylene)poly(oxypropylene), α-pentadecyl-ω-hydroxy-poly(oxyethylene)poly(oxypropylene), α-hexadecyl-ω-hydroxy-poly(oxyethylene)poly(oxypropylene), α-heptadecyl-ω-hydroxy-poly(oxyethylene)poly(oxypropylene), α-octadecyl-ω-hydroxy-poly(oxyethylene)poly(oxypropylene), α-nonadecyl-ω-hydroxy-poly(oxyethylene)poly(oxypropylene), α-eicosyl-ω-hydroxy-poly(oxyethylene)poly(oxypropylene), α-eicosenyl-ω-hydroxy-poly(oxyethylene)poly(oxypropylene) and α-docosyl-ω-hydroxy-poly(oxyethylene)poly(oxypropylene).

Examples of ether type nonionic surfactant with number average molecular weight of 900-2000 having ethylene oxide or propylene oxide added to monohydric aliphatic alcohol with 6-10 carbon atoms, serving as Component D, include α-hexyl-ω-hydroxy-polyoxyethylene, α-octyl-ω-hydroxy-polyoxyethylene, α-nonyl-ω-hydroxy-polyoxyethylene, α-decyl-ω-hydroxy-polyoxyethylene, α-hexyl-ω-hydroxy-polyoxypropylene, α-octyl-ω-hydroxy-polyoxypropylene, α-nonyl-ω-hydroxy-polyoxypropylene and α-decyl-ω-hydroxy-polyoxypropylene.

Examples of ether type nonionic surfactant with number average molecular weight of 150-2500 having ethylene oxide or propylene oxide added to monohydric aliphatic alcohol with 11-24 carbon atoms, serving as Component D, include α-undecyl-ω-hydroxy-polyoxyethylene, α-dodecyl-ω-hydroxy-polyoxyethylene, α-tridecyl-ω-hydroxy-polyoxyethylene, α-tetradecyl-ω-hydroxy-polyoxyethylene, α-pentadecyl-ω-hydroxy-polyoxyethylene, α-hexadecyl-ω-hydroxy-polyoxyethylene, α-heptadecyl-ω-hydroxy-polyoxyethylene, α-octadecyl-ω-hydroxy-polyoxyethylene, α-nonadecyl-ω-hydroxy-polyoxyethylene, α-eicosyl-ω-hydroxy-polyoxyethylene, α-eicosenyl-ω-hydroxy-polyoxyethylene, α-docosyl-ω-hydroxy-polyoxyethylene, α-dodecyl-ω-hydroxy-polyoxypropylene, α-tridecyl-ω-hydroxy-polyoxypropylene, α-tetradecyl-ω-hydroxy-polyoxypropylene, α-pentadecyl-ω-hydroxy-polyoxypropylene, α-hexadecyl-ω-hydroxy-polyoxypropylene, α-heptadecyl-ω-hydroxy-polyoxypropylene, α-octadecyl-ω-hydroxy-polyoxypropylene, α-nonadecyl-ω-hydroxy-polyoxypropylene, α-eicosyl-ω-hydroxy-polyoxypropylene, α-eicosenyl-ω-hydroxy-polyoxypropylene and α-docosyl-ω-hydroxy-polyoxypropylene.

Examples of ester type nonionic surfactant with number average molecular weight of 200-2000 having ethylene oxide and/or propylene oxide added to monohydric aliphatic acid with 8-24 carbon atoms, serving as Component D, include poly(oxyethylene) caprylate, poly(oxyethylene) laurate, poly(oxyethylene) myristate, poly(oxyethylene) palmitate, poly(oxyethylene) stearate, poly(oxyethylene) oleate, poly(oxyethylene) rinoleate, poly(oxyethylene) erucate, poly(oxyethylene) recinolate, poly(oxyethylene) lignocerate, poly(oxyethylene)poly(oxypropylene) caprylate, poly(oxyethylene)poly(oxypropylene) laurate, poly(oxyethylene) poly(oxypropylene) myristate, poly(oxyethylene)poly(oxypropylene) palmitate, poly(oxyethylene)poly(oxypropylene) stearate, poly(oxyethylene)poly(oxypropylene) oleate, poly(oxyethylene)poly(oxypropylene) rinoleate, poly(oxyethylene)poly(oxypropylene) erucate, poly(oxyethylene)poly(oxypropylene) recinolate, poly(oxyethylene)poly(oxypropylene) lignocerate, poly(oxypropylene) laurate, poly(oxypropylene) myristate, poly(oxypropylene) palmitate, poly(oxypropylene) stearate and poly(oxypropylene) oleate.

Examples of nonionic surfactant with number average molecular weight of 700-10000 having ethylene oxide and/or propylene oxide added to animal oils and/or vegetable oils, serving as Component D, include (1) ethylene oxide and/or propylene oxide adducts of vegetable oils such as soy beam oil, sunflower seed oil, cotton seed oil, sesame seed oil, rape seed oil, rice bran oil, castor oil, hydrogenated castor oil, palm oil, palm kernel oil and coconut oil; and (2) ethylene oxide and/or propylene oxide adducts of animal oils such as beef tallow, lard and mutton tallow.

Examples of aminoether type nonionic surfactant with number average molecular weight of 200-2500 having ethylene oxide and/or propylene oxide added to aliphatic amine with 8-24 carbon atoms, serving as Component D, include N,N-bis (2-hydroxyethyl) octylamine, N,N-bis (2-hydroxyethyl) nonylamine, N,N-bis (2-hydroxyethyl) laurylamine, N,N-bis (2-hydroxyethyl) myristylamine, N,N-bis (2-hydroxyethyl) cetylamine, N,N-bis (2-hydroxyethyl) stearylamine, N,N-bis (2-hydroxyethyl) aralkylamine, N-(2-hydroxyethyl) dioctylamine, N-(2-hydroxyethyl) dinonylamine, N-(2-hydroxyethyl) dilaurylamine, N-(2-hydroxyethyl) dimyristylamine, N-(2-hydroxyethyl) dicetylamine, N-(2-hydroxyethyl) distearylamine, N,N-bis (2-hydroxypropyl) octylamine, N,N-bis (2-hydroxypropyl) nonylamine, N,N-bis (2-hydroxypropyl) laurylamine, N,N-bis (polyoxyethylene) octylamine, N,N-bis (polyoxyethylene) nonylamine, N,N-bis (polyoxyethylene) laurylamine, N,N-bis (polyoxyethylene) myristylamine, N,N-bis (polyoxyethylene) cetylamine, N,N-bis (polyoxyethylene) stearylamine, N,N-bis (polyoxyethylene) aralkylamine, N-(polyoxyethylene) dioctylamine, N-(polyoxyethylene) dinonylamine, N-(polyoxyethylene) dilaurylamine, N-(polyoxyethylene) dimyrisitylamine, N-(polyoxyethylene) dicetylamine, N-(polyoxyethylene) distearylamine, N,N-bis (polyoxyethylene polypropylene) octylamine, N,N-bis (polyoxyethylene polypropylene) nonylamine, N,N-bis (polyoxyethylene polypropylene) laurylamine, N,N-bis (polyoxyethylene polypropylene) myristylamine, N,N-bis (polyoxyethylene polypropylene) cetylamine, N,N-bis (polyoxyethylene polypropylene) stearylamine, N,N-bis (polypropylene) octylamine, N,N-bis (polypropylene) nonylamine, N,N-bis (polypropylene) laurylamine, N,N-bis (polypropylene) myristylamine, N,N-bis (polypropylene) cetylamine and N,N-bis (polypropylene) stearylamine.

Examples of amidoether type nonionic surfactant with number average molecular weight of 250-2500 having ethylene oxide and/or propylene oxide added to aliphatic amide with 8-24 carbon atoms, serving as Component D, include N,N-bis (hydroxyethyl) octanamide, N,N-bis (hydroxyethyl) dodecanamide, N,N-bis (hydroxyethyl) octadecanamide, N,N-bis (hydroxyethyl) octadecenamide, N,N-bis (hydroxyethyl) docosanamide, N,N-bis (polyoxyethylene) octanamide, N,N-bis (polyoxyethylene) dodecanamide, N,N-bis (polyoxyethylene) octadecanamide, N,N-bis (polyoxyethylene) octadecenamide, N,N-bis (polyoxyethylene) docosanamide, N,N-bis (polyoxyethylene polyoxypropylene) octanamide, N,N-bis (polyoxyethylene polyoxypropylene) dodecanamide, N,N-bis (polyoxyethylene polyoxypropylene) octadecanamide, N,N-bis (polyoxyethylene polyoxypropylene) octadecenamide, N,N-bis (polyoxyethylene polyoxypropylene) docosanamide, N,N-bis (polyoxypropylene) octanamide, N,N-bis (polyoxypropylene) dodecanamide, N,N-bis (polyoxypropylene) octadecanamide, N,N-bis (polyoxypropylene) octadecenamide and N,N-bis (polyoxypropylene) docosanamide.

Examples of partial ester type nonionic surfactant having dihydric-hexahydric aliphatic alcohol with 2-6 carbon atoms partially esterified with aliphatic acid with 8-24 carbon atoms, serving as Component D, include (1) partial esters of ethyleneglycol such as ethyleneglycol monolaurate, ethyleneglycol monopalmitate, ethyleneglycol monooleate and ethyleneglycol behenate; (2) partial esters of propyleneglycol such as propyleneglycol monomyristate,propyleneglycol monopalmitate, propyleneglycol monostearate and propyleneglycol monooleate; (3) partial esters of glycerol such as glycerol monolaurate, glycerol monopalmitate, glycerol monooleate, glycerol monorinoleate, glycerol dilaurate, glycerol dioleate, glycerol laurate myristate and glycerol palmitoleate stearate; (4) partial esters of trimethylol propane such as trimethylol propane monolaurate, trimethylol propane palmitate, trimethylol propane monooleate and trimethylol propane monobehenate; (5) partial esters of pentaerythritol such as pentaerythritol monomyristrate, pentaerythritol monooleate, pentaerythritol dilaurate, pentaerythritol dirinoleate, pentaerythritol laurate myristate, pentaerythritol trioleate, pentaerythritol dilaurate myristate, pentaerythritol dipalmitoleate stearate and pentaerythritol dipalmitoleate oleate; (6) partial esters of diglycerol such as diglycerol monolaurate, diglycerol monooleate, diglycerol dipalmitate, diglycerol trilaurate, diglycerol dilaurate myristate and diglycerol stearate dipalmitoleate; (7) partial esters of sorbitan such as sorbitan monolaurate, sorbitan monostearate, sorbitan monooleate, sorbitan monorinolate, sorbitan dimyristate, sorbitan dipalmitate, sorbitan dioleate, sorbitan palmitoleate, sorbitan tripalmitate, sorbitan trioleate, sorbitan tririnoleate, sorbitan dilaurate myristate and sorbitan dipalmitoleate; (8) partial esters of triglycerol such as triglycerol monolaurate, triglycerol monooleate, triglycerol dioleate, triglycerol trilaurate, triglycerol trioleate and triglycerol palmitoleate dioleate; (9) partial esters of tetraglycerol such as tetraglycerol monolaurate, tetraglycerol monooleate and tetraglycerol dioleate; and (10) partial esters of dipentaerythritol such as dipentaerythritol monomyristate, dipentaerythritol monorinoleate and dipentaerythritol dioleate.

Examples of ether-ester nonionic surfactant with number average molecular weight of 400-6000 having ethylene oxide and/or propylene oxide added to partial ester having trihydric-hexahydric aliphatic alcohol with 3-6 carbon atoms partially esterified with aliphatic acid with 8-24 carbon atoms, serving as Component D, include ethylene oxide and/or propylene oxide adducts of partial esters such as glycerol partial esters, trimethylol propane partial esters, pentaerythritol partial esters, diglycerol partial esters, ethyleneglycol diglycerylether partial esters, sorbitan partial esters, triglycerol partial esters, tetraglycerol partial esters and dipentaerythritol partial esters.

Processing agents according to this invention are characterized as containing by 70 weight % or more a base oil composition that contains Component A by 50-90 weight %, Component B by 3-30 weight %, Component C by 0.1-10 weight % and Component D by 0.1-20 weight % such that Components A, B, C and D are contained by a total of 100 weight % but those containing by 80 weight % or more a base oil composition that contains Component A by 55-90 weight %, Component B by 5-20 weight %, Component C by 0.3-5 weight % and Component D by 1-20 weight % such that Components A, B, C and D are contained by a total of 100 weight % are preferred.

It is further preferable that processing agents further contain Component G which is one or more selected from aliphatic ester compounds shown by $R^1$—X—$R^2$ (Formula 1) and aliphatic ester compounds shown by $R^3$-$R^4$ (Formula 2) where $R^1$ and $R^3$ are each residual group obtainable by removing hydrogen atom from aliphatic monohydric alcohol with 8-18 carbon atoms, $R^2$ is residual group obtainable by removing hydrogen atom from aliphatic carboxylic acid with 8-18 carbon atoms and $R^4$ is residual group obtainable by removing hydroxyl group from aliphatic carboxylic acid with 8-18 carbon atoms. X is residual group obtainable by removing all hydroxyl groups from (poly)alkyleneglycol having (poly)oxyalkylene group formed with a total of 1-10 oxyethylene units and/or oxypropylene units.

In Formula 1, $R^1$ is a residual group obtainable by removing hydrogen atom from aliphatic monohydric alcohol with 8-18 carbon atoms such as octyl alcohol, lauryl alcohol, tridecyl alcohol, myristyl alcohol, cetyl alcohol, stearyl alcohol and oleyl alcohol. $R^2$ is a residual group obtainable by removing hydrogen atom from aliphatic monohydric carboxylic acid with 8-18 carbon atoms such as capronic acid, caprylic acid, caprinic acid, undecanoic acid, lauric acid, tridecanoic acid, myristic acid, pentadecanoic acid, palmitic acid, stearic acid, palmitoleic acid, oleic acid, isooctanoic acid, isohexadecanoic acid and isooctadecanoic acid. X is a residual group obtainable by removing all hydroxyl groups from (poly)alkyleneglycol having (poly)oxyalkylene group formed with a total of 1-10 oxyethylene units and/or oxypropylene units. Examples of such residual group include (1) residual groups obtainable by removing all hydroxyl groups from (poly)ethyleneglycol having (poly)oxyethylene group formed with a total of 1-10 oxyethylene units; (2) residual groups obtainable by removing all hydroxyl groups from (poly)propyleneglycol having (poly)oxypropylene group formed with a total of 1-10 oxypropylene units; and (3) residual groups obtainable by removing all hydroxyl groups from (poly)alkyleneglycol having (poly)oxyethylene(poly)oxypropylene group formed with a total of 2-10 oxyethylene units and oxypropylene units.

In Formula 2, $R^3$ is as explained above for $R^1$. $R^4$ is a residual group obtainable by removing hydroxyl group from aliphatic monohydric carboxylic acid with 8-18 carbon atoms such as capronic acid, caprylic acid, caprinic acid, undecanoic acid, lauric acid, tridecanoic acid, myristyc acid, pentadecanoic acid, palmitic acid, stearic acid, palmitoleic acid, oleic acid, isooctanoic acid, isohexadecanoic acid and isooctadecanoic acid.

If a processing agent of this invention contains Component G as described above, Component G is contained at a rate of 5-40 weight parts, and more preferable 5-30 weight parts, for 100 weight parts of the base oil composition.

It is further preferable that processing agents further contain Component H which is polyoxyalkylene modified silicone and/or dimethyl silicone and/or Component I one or more selected from phenol antioxidants, phosphite antioxidants and thioether antioxidants.

Examples of Component H include (1) polyoxyalkylene modified silicone; (2) dimethyl silicone; and (3) mixtures of (1) and (2), but polyoxyalkylene modified silicone is preferable. Preferable among the examples of polyoxyalkylene modified silicone are those having polyoxyalkylene groups comprising oxyalkylene units which are oxyethylene units and/or oxypropylene units and containing the polyoxyalkylene groups and silicone chains at weight ratio of 25/75-90/10. Examples of such polyoxyalkylene modified silicone include (1) polyoxyethylene modified silicone, (2) polyoxypropylene modified silicone, and (3) polyoxyethylenepolyoxypropylene modified silicone. Preferable among them are those having a polyoxyalkylene group of which more than 25 weight % of the total oxyalkylene units are oxyethylene units. The weight ratio between the polyoxyalkylene group and the silicone chain in the polyoxyalkylene modified silicone is preferably 25/75-90/10, and is more preferably 30/70-85/15. The number average molecular weight is preferably in the range of 2500-50000.

As for dimethyl silicone serving as Component H, linear dimethyl silicone with viscosity $1\times10^{-6}$-$1\times10^{-4}$ $m^2/s$ is preferred.

Examples of Component I include (1) phenol antioxidants; (2) phosphite antioxidants; (3) thioether antioxidants; and (4) mixtures of two or more selected from (1)-(3) above. Among those, however, phenol antioxidants are preferable.

Examples of phenol antioxidant serving as Component I include triethyleneglycol-bis[3-(3-t-butyl-5-methyl-4-hydroxyphenyl) propionate], 1,3,5-trimethyl-2,4,6-tris(3,5-di-t-butyl-4-hydroxybenzyl) benzene, 1,6-hexanediol-bis[3-(3,5-di-t-butyl-4-hydroxyphenyl) propionate], pentaerythritol-tetrakis[3-(3,5-di-t-butyl-4-hydroxyphenyl) propionate], 2,2'-methylene-bis-(6-t-butyl-4-methylphenol), 2,2'-butylidene-bis-(6-t-butyl-4-methylphenol), 1,1,3-tris(2-methyl-4-hydroxy-5-t-butylphenol) butane, 1,3,5-tris(3',5'-di-t-butyl-4-hydroxybenzyl) isocyanuric acid and 1,3,5-tris(4-butyl-3-hydroxy-2,6-dimethylbenzyl) isocyanuric acid, which are all known examples.

Examples of phosphite antioxidant serving as Component I include octyldiphenyl phosphite, trisnonylphenyl phosphite, tetratridecyl-4,4'-butylidene-bis-(2-t-butyl-5-methylphenol) diphosphite, mono(dinonylphenyl) phosphite and di(p-nonylphenyl) phosphite, which are all known examples.

Examples of thioether antioxidant serving as Component I include 4,4'-thiobis-(6-t-butyl-3-methylphenol) and dilauryl-3,3'-thiodipropionate, which are all known examples.

If a processing agent of this invention contains Component H and/or Component I, it is to contain Component H and/or Component I in a total amount of 0.3-6 weight parts for 100 weight parts of the base oil composition. It is preferable, however, to contain Component H in an amount of 0.5-3 weight parts and Component I in an amount of 0.5-3 weight parts.

Processing agents according to this invention may contain other components within the limitation of not adversely affecting the desired effects obtained by the invention. Examples of such other components that may be contained include emulsion coadjutants, lubricants such as mineral oils, antifoaming agents, antiseptics and antirust agents.

Next, the method according to this invention for processing synthetic fibers (hereinafter referred to simply as the method of this invention) is explained. The method of this invention is a method of applying a processing agent of this invention as described above at a rate of 0.1-3 weight % and more preferably 0.3-1.2 weight % of the synthetic fibers to be processed. The fabrication step during which a processing agent of this invention is to be applied to the synthetic fibers may be the spinning step or the step during which spinning and drawing are carried out simultaneously. Examples of the method of causing a processing agent of this invention to be attached to the synthetic fibers include the roller oiling method, the guide oiling method using a measuring pump, the emersion oiling method and the spray oiling method. The form in which a processing agent of this invention may be applied to synthetic fibers may be as a neat, as an organic solution or as an aqueous solution but the form as an aqueous solution is preferable, and it is particularly preferable as an aqueous solution of 5-30 weight %. When such a solution is applied, it is preferable to apply the solution at a rate of 0.1-3 weight % and more particular 0.3-1.2 weight % as the processing agent with respect to the synthetic fiber.

Examples of synthetic fibers that may be processed by a method of this invention include (1) polyester fibers such as polyethylene terephthalate, polypropylene terephthalate and polylactic ester fibers; (2) polyamide fibers such as nylon 6 and nylon 66; (3) polyacryl fibers such as polyacrylic and modacrylic fibers; (4) polyolefin fibers such as polyethylene and polypropylene fibers and polyurethane fibers. The present invention is particularly effective, however, when applied to polyester fibers and polyamide fibers.

The invention is described next by way of examples but it goes without saying that these examples are not intended to limit the scope of the invention. In what follows, "part" will mean "weight part" and "%" will mean "weight %" unless otherwise specified, For convenience of description, ethylene oxide and propylene oxide will be respectively written as EO and PO, and repetition numbers of oxyethylene units and oxypropylene units will be respectively written as n and m.

Part 1 (Preparation of Processing Agents for Synthetic Fibers)

TEST EXAMPLE 1

Preparation of Processing Agent (P-1)

Respectively 75 parts, 13 parts, 2 parts and 10 parts of Components A, B, C and D as described below were uniformly mixed together to prepare 100 parts of a base oil composition which was defined as processing agent (P-1).

Composition A: A mixture at weight ratio of 40/20/15 of polyether monool with number average molecular weight of 1000 with random addition of EO (ethylene oxide) and PO (propylene oxide) at weight ratio of 40/60 to 2-ethylhexyl alcohol, polyether monool number average molecular weight of 3000 with random addition of EO and PO at weight ratio of 50/50 to butyl alcohol, and polyether monool with number average molecular weight of 3500 with random addition of EO and PO at weight ratio of 70/30;

Composition B: Alkyleneoxide adduct with 5 moles of EO added to 1 mole of 3,5,5-trimethyl-hexyl alcohol;

Composition C: A mixture at weight ratio of 0.5/1/0.5 of potassium decansulfonate, potassium phosphate of α-dodecyl-ω-hydroxy poly(oxyethylene) (n=3, n being the number of oxyethylene units), and cis-9-potassium octadecenate;

Component D: A mixture at weight ratio of 5/5 of nonionic surfactant having 7 moles of EO added to one mole of cis-9-octadecenoic acid and nonionic surfactant having 20 moles of EO added to one mole of hydrogenated castor oil.

TEST EXAMPLES 2-36 AND COMPARISON EXAMPLES 1-28

Preparation of Processing Agents (P-2)-(P-36) and (R-1)-(R-28)

Processing agents (P-2)-(P-36) of Test Examples 2-36 and processing agents (R-1)-(R-28) of Comparison Examples 1-28 were prepared similarly as processing agent (P-1) of Test Example 1. Details of the components used for the preparation of these processing agents are shown in Tables 1-8 and the details of these processing agents are shown in Tables 9-18.

TABLE 1

| | Aliphatic alcohol used for synthesis | | | | Alkyleneoxide addition compound | | | |
|---|---|---|---|---|---|---|---|---|
| | Kind | Valence | Carbon atoms | Chain form | Kind of AO | EO Ratio | NAMW | E or F |
| A-1 | 2-ethylhexyl alcohol | 1 | 8 | B | EO/PO | 40 | 1000 | E |
| A-2 | Decyl alcohol | 1 | 10 | S | EO/PO | 60 | 2500 | E |
| A-3 | 2-ethylhexyl alcohol | 1 | 8 | B | EO/PO/BO | 20 | 3000 | |
| A-4 | Hexyl alcohol | 1 | 6 | S | EO/PO | 75 | 1000 | E |
| A-5 | Butyl alcohol | 1 | 4 | S | EO/PO | 50 | 3000 | |
| A-6 | Octadecyl alcohol | 1 | 18 | S | EO/PO | 40 | 2000 | |
| A-7 | Trimethylol propane | 3 | 6 | B | EO/PO | 40 | 6000 | |
| A-8 | Dodecyl alcohol | 1 | 12 | S | EO/PO | 70 | 3500 | F |
| A-9 | Isohexadecyl alcohol | 1 | 16 | B | EO/PO | 30 | 2000 | F |
| A-10 | Propylene glycol | 2 | 3 | S | EO/PO | 25 | 2000 | |
| a-1 | Sorbitan | 4 | 6 | B | EO/PO | 40 | 1500 | |
| a-2 | Glycerol | 3 | 3 | S | EO/PO | 30 | 20000 | |
| a-3 | Butanol | 1 | 4 | S | EO/BO | 90 | 2000 | |

In Table 1 (and thereafter):
Chain form: S for straight-chain and B for branched
Kind of AO: Kind of alkyleneoxide added to aliphatic alcohol
EO ratio: Ratio (%) of EO in AO
NAMW: Number average molecular weight
BO: Butylene oxide

TABLE 2

| | Aliphatic alcohol used for synthesis | | | Alkyleneoxide addition compound | | |
|---|---|---|---|---|---|---|
| | Kind | Valence | Carbon atoms | Kind of AO | EO ratio (%) | NAMW |
| B-1 | 3,3,5-trimethylhexyl alcohol | 1 | 9 | EO | 100 | 350 |
| B-2 | 2-methyloctyl alcohol | 1 | 9 | EO | 100 | 660 |
| B-3 | 2-ethylhexyl alcohol | 1 | 8 | EO/PO | 50 | 400 |
| B-4 | Hexyl alcohol | 1 | 6 | EO | 100 | 530 |

TABLE 3

| | Type | Compound name |
|---|---|---|
| C-1 | Anionic | Potassium decanesulfonate |
| C-2 | Anionic | Potassium dodecylpoly(oxyethylene)(n = 3) phosphate |
| C-3 | Anionic | Potassium cis-9-octadecenate |
| C-4 | Cationic | Tributylmethyl ammonium diethyl phosphate |
| C-5 | Amphoteric | Dimethyl dodecyl amine oxide |
| C-6 | Anionic | Potassium tetracosyl phosphate |

TABLE 4

| | Compound name | NAMW | *1 | Type |
|---|---|---|---|---|
| D-1 | ω-hydroxy (polyoxyethylene) (n = 7) octadecenate | 590 | 18 | Ester |
| D-2 | ω-hydroxy (polyoxyethylene) (n = 20) hydrogenated castor oil | 1820 | 57 | Fat derivatives |
| D-3 | α-dodecyl-ω-hydroxy (polyoxypropylene polyoxyethylene) (m = 3, n = 4) | 540 | 12 | Ether |
| D-4 | α-2-ethylhexyl-ω-hydroxy(polyoxyethylene)(n = 20) | 1010 | 8 | Ether |
| D-5 | α-dodecyl-ω-hydroxy(polyoxyethylene) (n = 7) | 480 | 12 | Ether |
| D-6 | N,N-bis(polyoxyethylene)dodecanamine(n = 10) | 620 | 12 | Amino-ether |
| D-7 | N,N-bis(polyoxyethylene)dodecanamide(n = 10) | 640 | 12 | Amido-ether |
| D-8 | Sorbitan monooleate | 430 | 6 | Partial ester |
| D-9 | Ethylene oxide adduct (n = 10) of trimethylpropanol di-(iso-octadecanate) | 1070 | 6 | Ether-ester |

In Table 4:
*1: Number of carbon atoms in the starting material used for the synthesis
m: Number of oxypropylene units

TABLE 5

| | Aliphatic ester compound shown | | | | |
|---|---|---|---|---|---|
| | $R^1$ | $R^2$ | $R^3$ | $R^4$ | X |
| G1 | | | Dodecyl group | Octanoyl group | |
| G2 | Dodecyl group | Nonylcarbonyloxy group | | | Polyoxyethylene (6 moles) |

TABLE 6

| | Description |
|---|---|
| H-1 | Polyoxyalkylene modified silicone with number average molecular weight = 16000; weight ratio of polyoxyalkylene group and silicone chain = 70/30; molar ratio of oxyethylene unit and oxypropylene unit = 50/50 |
| H-2 | Polyoxyalkylene modified silicone with number average molecular weight = 11000; weight ratio of polyoxyalkylene group and silicone chain = 35/65; molar ratio of oxyethylene unit and oxypropylene unit = 20/80 |
| H-3 | Dimethyl silicone with viscosity $1 \times 10^{-5}$ $m^2/s$ at 30° C. |

TABLE 7

| | Compound name | Type |
|---|---|---|
| I-1 | 1,3,5-tris(4-butyl-3-hydroxy-2,6-dimethyl benzyl) isocyanuric acid | Phenol antioxidant |
| I-2 | 2,2'-methylene-bis(4-methyl-6-t-butyl phenol) | Phenol antioxidant |
| I-3 | Octyl diphenyl phosphite | Phosphite antioxidant |
| I-4 | Didodecyl 3,3'-thiodipropionate | Thioether antioxidant |

TABLE 8

| | Compound name |
|---|---|
| J-1 | Ethylene glycol |
| J-2 | Diisodecyl adipate |
| J-3 | Mineral oil with viscosity $2.4 \times 10^{-5}$ $m^2/s$ at 30° C. |

TABLE 9

| | | Component (kind/used amount) | | | | | | | | | | |
|---|---|---|---|---|---|---|---|---|---|---|---|---|
| | | A | | B | | C | | D | | Other | | |
| Test Example | Kind | Kind | Part used | Kind | Part used | Kind | Part used | Kind | Part used | Kind | Part used | *2 |
| 1 | P-1 | A-1 | 40 | B-1 | 13 | C-1 | 0.5 | D-1 | 5 | | | 100 |
| | | A-5 | 20 | | | C-2 | 1 | D-2 | 5 | | | |
| | | A-8 | 15 | | | C-3 | 0.5 | | | | | |
| 2 | P-2 | A-2 | 40 | B-1 | 13 | C-1 | 0.5 | D-1 | 5 | | | 100 |
| | | A-5 | 20 | | | C-2 | 1 | D-2 | 5 | | | |
| | | A-8 | 15 | | | C-3 | 0.5 | | | | | |
| 3 | P-3 | A-1 | 40 | B-1 | 13 | C-1 | 0.5 | D-2 | 5 | | | 100 |
| | | A-3 | 20 | | | C-2 | 1 | D-5 | 5 | | | |
| | | A-8 | 15 | | | C-3 | 0.5 | | | | | |

TABLE 9-continued

| Test Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 4 | P-4 | A-4 | 40 | B-1 | 13 | C-1 | 0.5 | D-1 | 5 | | | 100 |
| | | A-5 | 20 | | | C-2 | 1 | D-8 | 3 | | | |
| | | A-8 | 15 | | | C-3 | 0.5 | D-9 | 2 | | | |
| 5 | P-5 | A-1 | 20 | B-1 | 13 | C-1 | 0.5 | D-1 | 5 | | | 100 |
| | | A-5 | 40 | | | C-2 | 1 | D-2 | 5 | | | |
| | | A-8 | 15 | | | C-3 | 0.5 | | | | | |
| 6 | P-6 | A-1 | 75 | B-1 | 13 | C-1 | 0.5 | D-1 | 5 | | | 100 |
| | | | | | | C-2 | 1 | D-2 | 5 | | | |
| | | | | | | C-3 | 0.5 | | | | | |
| 7 | P-7 | A-1 | 40 | B-1 | 13 | C-1 | 0.5 | D-1 | 8 | | | 100 |
| | | A-5 | 20 | | | C-2 | 1 | D-7 | 2 | | | |
| | | A-9 | 15 | | | C-3 | 0.5 | | | | | |
| 8 | P-8 | A-1 | 40 | B-1 | 13 | C-1 | 0.5 | D-2 | 7 | | | 100 |
| | | A-5 | 35 | | | C-2 | 1 | D-6 | 3 | | | |
| | | | | | | C-3 | 0.5 | | | | | |
| 9 | P-9 | A-1 | 40 | B-1 | 13 | C-1 | 0.5 | D-1 | 5 | | | 100 |
| | | A-5 | 25 | | | C-2 | 1 | D-2 | 5 | | | |
| | | A-8 | 10 | | | C-3 | 0.5 | | | | | |
| 10 | P-10 | A-1 | 40 | B-1 | 13 | C-1 | 0.5 | D-1 | 5 | | | 100 |
| | | A-5 | 13 | | | C-2 | 1 | D-2 | 5 | | | |
| | | A-8 | 22 | | | C-3 | 0.5 | | | | | |
| 11 | P-11 | A-1 | 40 | B-1 | 13 | C-1 | 0.5 | D-1 | 5 | | | 100 |
| | | A-6 | 20 | | | C-2 | 1 | D-2 | 5 | | | |
| | | A-8 | 15 | | | C-3 | 0.5 | | | | | |
| 12 | P-12 | A-1 | 40 | B-1 | 13 | C-1 | 0.5 | D-1 | 5 | J-1 | 2 | 98.0 |
| | | A-7 | 20 | | | C-2 | 1 | D-2 | 5 | | | |
| | | A-8 | 15 | | | C-3 | 0.5 | | | | | |

In Table 9 and thereafter:
*2: Ratio (%) of base oil composition in processing agent

TABLE 10

| Test Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 1 | 75 | 13 | 2 | 10 | 0 | 0 | 0 | 53.3 | 73.3 | 2.7 |
| 2 | 75 | 13 | 2 | 10 | 0 | 0 | 0 | 53.3 | 73.3 | 2.7 |
| 3 | 75 | 13 | 2 | 10 | 0 | 0 | 0 | 80 | 73.3 | 2.7 |
| 4 | 75 | 13 | 2 | 10 | 0 | 0 | 0 | 53.3 | 73.3 | 2.7 |
| 5 | 75 | 13 | 2 | 10 | 0 | 0 | 0 | 26.7 | 46.6 | 1.3 |
| 6 | 75 | 13 | 2 | 10 | 0 | 0 | 0 | 100 | 100 | 100 |
| 7 | 75 | 13 | 2 | 10 | 0 | 0 | 0 | 53.3 | 73.3 | 2.7 |
| 8 | 75 | 13 | 2 | 10 | 0 | 0 | 0 | 53.3 | 53.3 | 100 |
| 9 | 75 | 13 | 2 | 10 | 0 | 0 | 0 | 53.3 | 50 | 4 |
| 10 | 75 | 13 | 2 | 10 | 0 | 0 | 0 | 53.3 | 82.7 | 1.8 |

TABLE 10-continued

| Test Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 11 | 75 | 13 | 2 | 10 | 0 | 0 | 0 | 53.3 | 73.3 | 2.7 |
| 12 | 75 | 13 | 2 | 10 | 0 | 0 | 0 | 53.3 | 73.3 | 2.7 |

In Table 10 and thereafter:
*3: Ratio (%) of alkylene oxide adducts at which ethylene oxide and propylene oxide are added to monohydric aliphatic alcohol with 6–10 carbon atoms in Component A;
*4: The total ratio (%) of Components E and F in Component A;
*5: Weight ratio of Component E to Component F.

TABLE 11

| Test Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 13 | P-13 | A-1 | 30 | B-1 | 20 | C-1 | 0.5 | D-1 | 5 | | | 100 |
| | | A-5 | 20 | | | C-2 | 1 | D-2 | 5 | | | |
| | | A-8 | 10 | | | C-3 | 0.5 | D-3 | 8 | | | |
| 14 | P-14 | A-1 | 40 | B-1 | 10 | C-1 | 0.5 | D-2 | 3 | | | 100 |
| | | A-5 | 25 | | | C-2 | 1 | | | | | |
| | | A-8 | 20 | | | C-3 | 0.5 | | | | | |

TABLE 11-continued

| Test Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 15 | P-15 | A-1 | 40 | B-2 | 13 | C-1 | 0.5 | D-1 | | 5 | | 100 |
| | | A-5 | 20 | | | C-2 | 1 | D-2 | | 5 | | |
| | | A-8 | 15 | | | C-3 | 0.5 | | | | | |
| 16 | P-16 | A-1 | 40 | B-3 | 13 | C-1 | 0.5 | D-1 | | 5 | | 100 |
| | | A-5 | 20 | | | C-2 | 1 | D-2 | | 5 | | |
| | | A-8 | 15 | | | C-3 | 0.5 | | | | | |
| 17 | P-17 | A-1 | 40 | B-1 | 8 | C-1 | 0.5 | D-2 | | 5 | | 100 |
| | | A-5 | 25 | | | C-2 | 1 | D-5 | | 5 | | |
| | | A-8 | 15 | | | C-3 | 0.5 | | | | | |
| 18 | P-18 | A-1 | 40 | B-1 | 4 | C-1 | 0.5 | D-1 | | 5 | | 100 |
| | | A-5 | 25 | | | C-2 | 1 | D-2 | | 5 | | |
| | | A-8 | 15 | | | C-3 | 0.5 | D-3 | | 4 | | |
| 19 | P-19 | A-1 | 35 | B-1 | 25 | C-1 | 0.5 | D-1 | | 5 | | 100 |
| | | A-5 | 16 | | | C-2 | 1 | D-2 | | 5 | | |
| | | A-8 | 12 | | | C-3 | 0.5 | | | | | |
| 20 | P-20 | A-1 | 40 | B-1 | 13 | C-4 | 1 | D-1 | | 5 | | 100 |
| | | A-5 | 20 | | | C-5 | 1 | D-7 | | 1 | | |
| | | A-8 | 15 | | | | | D-8 | | 4 | | |
| 21 | P-21 | A-1 | 40 | B-1 | 13 | C-1 | 0.3 | D-1 | | 5 | | 100 |
| | | A-5 | 20 | | | C-2 | 0.3 | D-2 | | 5 | | |
| | | A-8 | 16.4 | | | | | | | | | |
| 22 | P-22 | A-1 | 40 | B-1 | 13 | C-1 | 0.2 | D-1 | | 5 | | 100 |
| | | A-5 | 20 | | | | | D-2 | | 5 | | |
| | | A-8 | 16.8 | | | | | | | | | |
| 23 | P-23 | A-1 | 40 | B-1 | 13 | C-1 | 3 | D-1 | | 5 | | 100 |
| | | A-5 | 16 | | | C-2 | 3 | D-2 | | 5 | | |
| | | A-8 | 13 | | | C-3 | 2 | | | | | |
| 24 | P-24 | A-1 | 40 | B-1 | 16 | C-1 | 0.5 | D-5 | | 2 | | 100 |
| | | A-5 | 25 | | | C-2 | 1 | | | | | |
| | | A-8 | 15 | | | C-3 | 0.5 | | | | | |

TABLE 12

| Test Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 13 | 60 | 20 | 2 | 18 | 0 | 0 | 0 | 50 | 66.7 | 3.0 |
| 14 | 85 | 10 | 2 | 3 | 0 | 0 | 0 | 47 | 70.6 | 2.0 |
| 15 | 75 | 13 | 2 | 10 | 0 | 0 | 0 | 53.3 | 73.3 | 2.7 |
| 16 | 75 | 13 | 2 | 10 | 0 | 0 | 0 | 53.3 | 73.3 | 2.7 |
| 17 | 80 | 8 | 2 | 10 | 0 | 0 | 0 | 50 | 68.8 | 2.7 |
| 18 | 80 | 4 | 2 | 14 | 0 | 0 | 0 | 50 | 68.8 | 2.7 |
| 19 | 63 | 25 | 2 | 10 | 0 | 0 | 0 | 55.6 | 74.6 | 2.9 |

TABLE 12-continued

| Test Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 20 | 75 | 13 | 2 | 10 | 0 | 0 | 0 | 53.3 | 73.3 | 2.7 |
| 21 | 76.4 | 13 | 0.6 | 10 | 0 | 0 | 0 | 52.4 | 73.4 | 2.4 |
| 22 | 76.8 | 13 | 0.2 | 10 | 0 | 0 | 0 | 52.1 | 74.0 | 2.4 |
| 23 | 69 | 13 | 8 | 10 | 0 | 0 | 0 | 58.0 | 76.8 | 3.1 |
| 24 | 80 | 16 | 2 | 2 | 0 | 0 | 0 | 50 | 68.8 | 2.7 |

TABLE 13

| Test Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 25 | P-25 | A-1 | 40 | B-1 | 17.5 | C-1 | 0.5 | D-3 | 0.5 | | | 100 |
| | | A-5 | 20 | | | C-2 | 1 | | | | | |
| | | A-8 | 15 | | | C-3 | 0.5 | | | | | |
| 26 | P-26 | A-1 | 36 | B-1 | 13 | C-1 | 0.5 | D-1 | 6 | | | 100 |
| | | A-5 | 18 | | | C-2 | 1 | D-2 | 6 | | | |
| | | A-8 | 13 | | | C-3 | 0.5 | D-3 | 6 | | | |
| 27 | P-27 | A-1 | 40 | B-1 | 13 | C-1 | 0.5 | D-2 | 5 | G-1 | 15 | 87.0 |
| | | A-5 | 20 | | | C-2 | 1 | D-5 | 5 | | | |
| | | A-8 | 15 | | | C-3 | 0.5 | | | | | |

TABLE 13-continued

| Test Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 28 | P-28 | A-1 | 40 | B-1 | 13 | C-1 | 0.5 | D-1 | 5 | G-2 | 25 | 80.0 |
| | | A-5 | 20 | | | C-2 | 1 | D-2 | 5 | | | |
| | | A-8 | 15 | | | C-3 | 0.5 | | | | | |
| 29 | P-29 | A-1 | 40 | B-1 | 13 | C-1 | 0.5 | D-1 | 5 | G-2 | 6 | 94.3 |
| | | A-5 | 20 | | | C-2 | 1 | D-2 | 5 | | | |
| | | A-8 | 15 | | | C-3 | 0.5 | | | | | |
| 30 | P-30 | A-1 | 40 | B-1 | 13 | C-1 | 0.5 | D-1 | 5 | G-2 | 35 | 71.4 |
| | | A-5 | 20 | | | C-2 | 1 | D-2 | 5 | J-2 | 5 | |
| | | A-8 | 15 | | | C-3 | 0.5 | | | | | |
| 31 | P-31 | A-1 | 40 | B-1 | 13 | C-1 | 0.5 | D-1 | 5 | H-1 | 1 | 98.0 |
| | | A-5 | 20 | | | C-2 | 1 | D-2 | 5 | I-1 | 1 | |
| | | A-8 | 15 | | | C-3 | 0.5 | | | | | |
| 32 | P-32 | A-1 | 40 | B-1 | 13 | C-1 | 0.5 | D-1 | 5 | H-2 | 0.5 | 99.5 |
| | | A-5 | 20 | | | C-2 | 1 | D-2 | 5 | | | |
| | | A-8 | 15 | | | C-3 | 0.5 | | | | | |
| 33 | P-33 | A-1 | 40 | B-1 | 13 | C-1 | 0.5 | D-1 | 5 | H-1 | 2 | 95.2 |
| | | A-5 | 20 | | | C-2 | 1 | D-2 | 5 | I-2 | 1.5 | |
| | | A-8 | 15 | | | C-3 | 0.5 | | | I-3 | 1.5 | |
| 34 | P-34 | A-1 | 40 | B-1 | 13 | C-1 | 0.5 | D-1 | 5 | G-2 | 20 | 82.0 |
| | | A-5 | 20 | | | C-2 | 1 | D-2 | 5 | H-1 | 1 | |
| | | A-8 | 15 | | | C-3 | 0.5 | | | I-1 | 1 | |
| 35 | P-35 | A-2 | 40 | B-1 | 13 | C-1 | 0.5 | D-3 | 5 | G-1 | 5 | 85.5 |
| | | A-5 | 20 | | | C-2 | 1 | D-5 | 5 | G-2 | 10 | |
| | | A-9 | 15 | | | C-3 | 0.5 | | | H-3 | 1 | |
| | | | | | | | | | | I-4 | 1 | |
| 36 | P-36 | A-2 | 40 | B-1 | 13 | C-1 | 0.5 | D-3 | 10 | G-2 | 15 | 84.4 |
| | | A-5 | 20 | | | C-2 | 1 | | | H-2 | 1 | |
| | | A-8 | 15 | | | C-3 | 0.5 | | | I-1 | 0.5 | |
| | | | | | | | | | | J-1 | 2 | |

TABLE 14

| Test Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 25 | 78.9 | 18.4 | 2.1 | 0.5 | 0 | 0 | 0 | 53.3 | 68.8 | 2.7 |
| 26 | 67 | 13 | 2 | 18 | 0 | 0 | 0 | 53.7 | 73.1 | 2.7 |
| 27 | 75 | 13 | 2 | 10 | 15 | 0 | 0 | 53.3 | 73.3 | 2.7 |
| 28 | 75 | 13 | 2 | 10 | 25 | 0 | 0 | 53.3 | 73.3 | 2.7 |
| 29 | 75 | 13 | 2 | 10 | 6 | 0 | 0 | 53.3 | 73.3 | 2.7 |
| 30 | 75 | 13 | 2 | 10 | 35 | 0 | 0 | 53.3 | 73.3 | 2.7 |
| 31 | 75 | 13 | 2 | 10 | 0 | 1 | 1 | 53.3 | 73.3 | 2.7 |

TABLE 14-continued

| Test Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 32 | 75 | 13 | 2 | 10 | 0 | 0.5 | 0 | 53.3 | 73.3 | 2.7 |
| 33 | 75 | 13 | 2 | 10 | 0 | 2 | 3 | 53.3 | 73.3 | 2.7 |
| 34 | 75 | 13 | 2 | 10 | 20 | 1 | 1 | 53.3 | 73.3 | 2.7 |
| 35 | 75 | 13 | 2 | 10 | 15 | 1 | 1 | 53.3 | 73.3 | 2.7 |
| 36 | 75 | 13 | 2 | 10 | 15 | 1 | 0.5 | 53.3 | 73.3 | 2.7 |

TABLE 15

| Comparison Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 1 | R-1 | A-1 | 10 | B-1 | 13 | C-1 | 0.5 | D-1 | 5 | | | 100 |
| | | A-5 | 45 | | | C-2 | 1 | D-2 | 5 | | | |
| | | A-8 | 20 | | | C-3 | 0.5 | | | | | |
| 2 | R-2 | A-5 | 20 | B-1 | 13 | C-1 | 0.5 | D-1 | 5 | | | 100 |
| | | A-6 | 40 | | | C-2 | 1 | D-2 | 5 | | | |
| | | A-8 | 15 | | | C-3 | 0.5 | | | | | |
| 3 | R-3 | A-1 | 20 | B-1 | 18 | C-1 | 0.5 | D-1 | 15 | | | 100 |
| | | A-5 | 20 | | | C-2 | 1 | D-2 | 15 | | | |
| | | | | | | C-3 | 0.5 | D-3 | 10 | | | |

TABLE 15-continued

| Comparison Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 4 | R-4 | A-1 | 40 | B-1 | 4 | C-1 | 0.5 | D-2 | 0.5 | | | 100 |
| | | A-5 | 30 | | | | | | | | | |
| | | A-8 | 25 | | | | | | | | | |
| 5 | R-5 | a-1 | 75 | B-1 | 13 | C-1 | 0.5 | D-1 | 5 | | | 25 |
| | | | | | | C-2 | 1 | D-2 | 5 | | | |
| | | | | | | C-3 | 0.5 | | | | | |
| 6 | R-6 | a-2 | 75 | B-1 | 13 | C-1 | 0.5 | D-1 | 5 | | | 25 |
| | | | | | | C-2 | 1 | D-2 | 5 | | | |
| | | | | | | C-3 | 0.5 | | | | | |
| 7 | R-7 | a-3 | 75 | B-1 | 13 | C-1 | 0.5 | D-1 | 5 | | | 25 |
| | | | | | | C-2 | 1 | D-2 | 5 | | | |
| | | | | | | C-3 | 0.5 | | | | | |
| 8 | R-8 | A-1 | 40 | B-1 | 2 | C-1 | 0.5 | D-1 | 5 | | | 100 |
| | | A-5 | 26 | | | C-2 | 1 | D-2 | 5 | | | |
| | | A-8 | 20 | | | C-3 | 0.5 | | | | | |
| 9 | R-9 | A-1 | 40 | | | C-1 | 0.5 | D-1 | 5 | | | 100 |
| | | A-5 | 20 | | | C-2 | 1 | D-2 | 5 | | | |
| | | A-8 | 15 | | | C-3 | 0.5 | D-3 | 13 | | | |
| 10 | R-10 | A-1 | 40 | | | C-1 | 0.5 | D-3 | 13 | | | 100 |
| | | A-5 | 25 | | | C-2 | 1 | | | | | |
| | | A-8 | 20 | | | C-3 | 0.5 | | | | | |
| 11 | R-11 | A-1 | 40 | | | C-1 | 0.5 | D-4 | 13 | | | 100 |
| | | A-5 | 25 | | | C-2 | 1 | | | | | |
| | | A-8 | 20 | | | C-3 | 0.5 | | | | | |
| 12 | R-12 | A-1 | 30 | B-1 | 40 | C-1 | 0.5 | D-1 | 5 | J-1 | 3 | 97 |
| | | A-5 | 15 | | | C-2 | 1 | | | | | |
| | | A-8 | 5 | | | C-3 | 0.5 | | | | | |
| 13 | R-13 | A-1 | 40 | B-1 | 13 | | | D-1 | 5 | | | 100 |
| | | A-5 | 20 | | | | | D-2 | 5 | | | |
| | | A-8 | 17 | | | | | | | | | |
| 14 | R-14 | A-1 | 30 | B-1 | 13 | C-1 | 5 | D-1 | 5 | | | 100 |
| | | A-5 | 20 | | | C-2 | 5 | D-2 | 5 | | | |
| | | A-8 | 12 | | | C-3 | 5 | | | | | |

TABLE 16

| Comparison Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 1 | 75 | 13 | 2 | 10 | 0 | 0 | 0 | 13.3 | 40 | 0.5 |
| 2 | 75 | 13 | 2 | 10 | 0 | 0 | 0 | 0 | 20 | 0 |
| 3 | 40 | 18 | 2 | 40 | 0 | 0 | 0 | 50 | 50 | 100 |
| 4 | 95 | 4 | 0.5 | 0.5 | 0 | 0 | 0 | 42.1 | 68.4 | 1.6 |
| 5 | 0 | 52 | 8 | 40 | 0 | 0 | 0 | 0 | 0 | 0 |
| 6 | 0 | 52 | 8 | 40 | 0 | 0 | 0 | 0 | 0 | 0 |
| 7 | 0 | 52 | 8 | 40 | 0 | 0 | 0 | 0 | 0 | 0 |
| 8 | 86 | 2 | 2 | 10 | 0 | 0 | 0 | 46.5 | 69.8 | 2.0 |

TABLE 16-continued

| Comparison Examples | Composition (%) of base oil composition A | B | C | D | Ratio (part) per 100 parts of base oil composition G | H | I | Details of Component A *3 | *4 | *5 |
|---|---|---|---|---|---|---|---|---|---|---|
| 9 | 75 | 0 | 2 | 23 | 0 | 0 | 0 | 53.3 | 73.3 | 2.7 |
| 10 | 85 | 0 | 2 | 13 | 0 | 0 | 0 | 47.1 | 70.6 | 2.0 |
| 11 | 85 | 0 | 2 | 13 | 0 | 0 | 0 | 47.1 | 70.6 | 2.0 |
| 12 | 51.5 | 41.2 | 2.1 | 5.2 | 0 | 0 | 0 | 60 | 70.0 | 6.0 |
| 13 | 77 | 13 | 0 | 10 | 0 | 0 | 0 | 51.9 | 74.0 | 2.4 |
| 14 | 62 | 13 | 15 | 10 | 0 | 0 | 0 | 48.4 | 67.8 | 2.5 |

TABLE 17

| Comparison Example | Kind | Component (kind/used amount) A Kind | A Part used | B Kind | B Part used | C Kind | C Part used | D Kind | D Part used | Other Kind | Other Part used | *2 |
|---|---|---|---|---|---|---|---|---|---|---|---|---|
| 15 | R-15 | A-1 | 40 | B-1 | 13 | C-1 | 0.5 | | | | | 100 |
| | | A-5 | 25 | | | C-2 | 1 | | | | | |
| | | A-8 | 20 | | | C-3 | 0.5 | | | | | |

TABLE 17-continued

| | | Component (kind/used amount) | | | | | | | | | | |
|---|---|---|---|---|---|---|---|---|---|---|---|---|
| | | A | | B | | C | | D | | Other | | |
| Comparison Example | Kind | Kind | Part used | Kind | Part used | Kind | Part used | Kind | Part used | Kind | Part used | *2 |
| 16 | R-16 | A-1 | 40 | B-1 | 13 | C-1 | 0.5 | D-4 | 10 | | | 100 |
| | | A-5 | 20 | | | C-2 | 1 | | | | | |
| | | A-8 | 15 | | | C-3 | 0.5 | | | | | |
| 17 | R-17 | A-1 | 30 | B-1 | 13 | C-1 | 0.5 | D-1 | 10 | | | 100 |
| | | A-5 | 15 | | | C-2 | 1 | D-2 | 10 | | | |
| | | A-8 | 10 | | | C-3 | 0.5 | D-3 | 10 | | | |
| 18 | R-18 | A-1 | 55 | | | C-2 | 4 | | | H-1 | 1 | 99 |
| | | A-8 | 40 | | | | | | | | | |
| 19 | R-19 | A-7 | 56 | | | C-3 | 1 | | | G-1 | 20 | 80 |
| | | A-8 | 20 | | | C-5 | 3 | | | | | |
| 20 | R-20 | A-1 | 29 | | | C-2 | 5 | D-3 | 5 | G-2 | 40 | 59 |
| | | A-8 | 20 | | | | | | | H-1 | 1 | |
| 21 | R-21 | A-5 | 47 | | | C-3 | 2 | | | H-1 | 1 | 99.0 |
| | | A-7 | 32 | | | | | | | | | |
| | | A-8 | 16 | | | | | | | | | |
| 22 | R-22 | A-1 | 50 | | | C-1 | 0.5 | D-3 | 10 | H-1 | 1.5 | 98.5 |
| | | A-6 | 37 | | | C-2 | 0.5 | | | | | |
| | | | | | | C-3 | 0.5 | | | | | |
| 23 | R-23 | A-7 | 75 | | | C-1 | 1 | D-1 | 2 | G-2 | 10 | 88.5 |
| | | | | | | C-2 | 0.5 | D-3 | 10 | H-1 | 1 | |
| | | | | | | | | | | I-1 | 0.5 | |
| 24 | R-24 | | | B-3 | 8 | C-1 | 4 | D-2 | 6 | G-1 | 45 | 37.5 |
| | | | | | | C-6 | 4 | D-3 | 2 | J-3 | 15 | |
| | | | | | | | | D-4 | 12 | | | |
| 25 | R-25 | A-10 | 86.4 | B-4 | 10 | C-2 | 1.8 | | | | | 100 |
| | | | | | | C-3 | 1.8 | | | | | |
| 26 | R-26 | A-5 | 49.6 | B-1 | 8 | C-1 | 2 | D-2 | 6.4 | | | 100 |
| | | A-9 | 30.4 | | | C-4 | 2 | D-3 | 1.6 | | | |
| 27 | R-27 | A-5 | 46.5 | B-1 | 7 | C-1 | 0.8 | D-3 | 10.1 | J-1 | 5.9 | 94.1 |
| | | A-9 | 28.5 | | | C-2 | 1.2 | | | | | |
| 28 | R-28 | A-5 | 53.7 | B-2 | 12 | C-4 | 5 | D-3 | 9.5 | G-2 | 14.3 | 80.2 |
| | | | | | | | | | | J-1 | 5.5 | |

TABLE 18

| | Composition (%) of base oil composition | | | | Ratio (part) per 100 parts of base oil composition | | | Details of Component A | | |
|---|---|---|---|---|---|---|---|---|---|---|
| Comparison Examples | A | B | C | D | G | H | I | *3 | *4 | *5 |
| 15 | 85 | 13 | 2 | 0 | 0 | 0 | 0 | 47.1 | 70.6 | 2.0 |
| 16 | 75 | 13 | 2 | 10 | 0 | 0 | 0 | 53.3 | 73.3 | 2.7 |
| 17 | 55 | 13 | 2 | 30 | 0 | 0 | 0 | 54.5 | 72.7 | 3.0 |
| 18 | 96 | 0 | 4 | 0 | 0 | 1 | 0 | 57.9 | 100 | 1.4 |
| 19 | 95 | 0 | 5 | 0 | 25 | 0 | 0 | 0 | 26.3 | 0 |
| 20 | 83.1 | 0 | 8.5 | 8.5 | 67.8 | 1.7 | 0 | 59.2 | 100 | 1.5 |
| 21 | 97.9 | 0 | 2.1 | 0 | 0 | 1 | 0 | 0 | 16.8 | 0 |
| 22 | 88.3 | 0 | 1.5 | 10.2 | 0 | 1.5 | 0 | 57.5 | 57.5 | 100 |
| 23 | 84.7 | 0 | 1.7 | 13.6 | 11.3 | 1.7 | 0.6 | 0 | 0 | 0 |
| 24 | 0 | 22.2 | 22.2 | 55.6 | 125 | 0 | 0 | 0 | 0 | 0 |
| 25 | 86.4 | 10 | 3.6 | 0 | 0 | 0 | 0 | 0 | 0 | 0 |
| 26 | 80 | 8 | 4 | 8 | 0 | 0 | 0 | 0 | 38.0 | 0 |
| 27 | 79.7 | 7.4 | 2.1 | 10.7 | 0 | 0 | 0 | 0 | 38.0 | 0 |
| 28 | 67 | 15 | 6.2 | 11.8 | 17.8 | 0 | 0 | 0 | 0 | 0 |

Part 2

Attachment of Processing Agent onto Synthetic Fibers

Each of the processing agents prepared in Part 1 was uniformly mixed with diluting water to prepare a 10% aqueous solution. After polyethylene terephthalate chips with intrinsic viscosity of 0.64 and containing titanium oxide by 0.2% were dried by a known method, they were spun at 295° C. by using an extruder. The 10% aqueous solution thus prepared was applied onto the yarns extruded out of the nozzle to be cooled and solidified by a guide oiling method using a measuring pump such that the attached amount of the processing agent became as shown in Table 19 or 20. Thereafter, the yarns were collected by means of a guide and wound up at the rate of 3000 m/minute without any drawing by a mechanical means to obtain partially drawn 128 decitex-36 filament yarns as wound cakes of 10 kg.

False Twisting

The cakes thus obtained as described above were subjected to a false twisting process under the conditions described below by using a false twister of the contact heater type (product name of SDS1200 produced by Teijinseiki Co., Ltd.):

Fabrication speeds: 700 m/minute and 1000 m/minute;

Draw ratio: 1.652;

Twisting system: Three-axis disk friction method (with one guide disk on the inlet side, one guide disk on the outlet side and four hard polyurethane disks);

Heater on twisting side: Length of 2.5 m with surface temperature of 210° C.;

Heater on untwisting side; None;

Target number of twisting; 3300T/m.

The false twisting process was carried out under the conditions given above by a continuous operation of 25 days.

Evaluation of Fluffs

In the aforementioned false twisting process, the number of fluffs per hour was measured by means of a fly counter (produce name of DT-105 produced by Toray Engineering Co., Ltd.) before the false twisted yarns were wound up and evaluated according to the standards as described below:

AAA: The measured number of fluffs was zero;

AA: The measured number of fluffs was less than 1 (exclusive of zero);

A: The measured number of fluffs was 1-2;

B: The measured number of fluffs was 3-9;

C: The measured number of fluffs was 10 or greater.

The results of the measurement are shown in Tables 19 and 20.

Evaluation of Yarn Breaking

The number of occurrences of yarn breaking during the 25 days of operation in the false twisting process described above was converted into the number per day and such converted numbers were evaluated according to the standards as described below:

AAA: The number of occurrence was zero;

AA: The number of occurrence was less than 0.5 (exclusive of zero);

A: The number of occurrence was 0.5 or greater and less than 1;

B: The number of occurrence was 1 or greater and less than 5;

C: The number of occurrence was 5 or greater.

The results are shown in Tables 19 and 20.

Dyeing Property

A fabric with diameter of 70 mm and length of 1.2 m was produced from the false-twisted yarns on which fluffs were measured as above by using a knitting machine for tubular fabric. The fabric thus produced was dyed by a high temperature and high pressure dyeing method by using disperse dyes (product name of Kayalon Polyester Blue-EBL-E produced by Nippon Kayaku Co. Ltd.). The dyed fabrics were washed with water, subjected to a reduction clearing process and dried according to a known routine and were thereafter set on an iron cylinder with diameter 70 mm and length 1 m. An inspection process for visually counting the number of points of densely dyed potion on the fabric surface was repeated five times and the evaluation results thus obtained were converted into the number of points per sheet of fabric. The evaluation was carried out according to the following standards:

AAA: There was no densely dyed portion;

AA: There was 1 point of densely dyed portion;

A: There were 2 points of densely dyed portion;

B: There were 3-6 points of densely dyed portion;

C: There were 7 or more points of densely dyed portion.

The results are shown in Tables 19 and 20.

From the results shown in Tables 19 and 20, it should be clear that the present invention has the favorable effects of sufficiently preventing the occurrence of fluffs, yard breaking and uneven dyeing as the speed of the spinning and fabrication processes of synthetic fibers is increased in recent years.

TABLE 19

| | | | Speed of false twisting process | | | | | |
|---|---|---|---|---|---|---|---|---|
| | | | 700 m/minute | | | 1000 m/minute | | |
| Test Example | Kind | Attached amount | Fluffs | Yarn breaking | Dyeing property | Fluffs | Yarn breaking | Dyeing property |
| 37 | P-1 | 0.4 | AAA | AAA | AAA | AA | AAA | AAA |
| 38 | P-2 | 0.5 | AAA | AAA | AAA | AA | AAA | AAA |
| 39 | P-3 | 0.4 | AAA | AAA | AAA | AA | AAA | AAA |
| 40 | P-4 | 0.3 | AAA | AAA | AAA | AA | AAA | AAA |
| 41 | P-5 | 0.4 | AAA | AAA | AAA | AA | AA | AAA |
| 42 | P-6 | 0.4 | AAA | AAA | AAA | AA | AAA | AA |
| 43 | P-7 | 0.4 | AAA | AAA | AAA | AA | AA | AAA |
| 44 | P-8 | 0.4 | AAA | AAA | AAA | AA | AA | AA |
| 45 | P-9 | 0.4 | AAA | AAA | AAA | AA | AAA | AAA |
| 46 | P-10 | 0.4 | AAA | AAA | AAA | AA | AAA | AAA |
| 47 | P-11 | 0.4 | AAA | AAA | AAA | AA | AAA | AAA |
| 48 | P-12 | 0.4 | AAA | AAA | AAA | AA | AAA | AAA |
| 49 | P-13 | 0.5 | AAA | AAA | AAA | AA | AAA | AAA |
| 50 | P-14 | 0.4 | AAA | AAA | AAA | AA | AAA | AAA |
| 51 | P-15 | 0.4 | AAA | AAA | AAA | AA | AAA | AAA |
| 52 | P-16 | 0.4 | AAA | AAA | AAA | AA | AAA | AAA |

TABLE 19-continued

| Test Example | Kind | Attached amount | Speed of false twisting process: 700 m/minute Fluffs | Yarn breaking | Dyeing property | 1000 m/minute Fluffs | Yarn breaking | Dyeing property |
|---|---|---|---|---|---|---|---|---|
| 53 | P-17 | 0.4 | AAA | AAA | AAA | AA | AAA | AAA |
| 54 | P-18 | 0.4 | AAA | AAA | AAA | AA | AAA | AA |
| 55 | P-19 | 0.4 | AAA | AAA | AAA | AA | AA | AAA |
| 56 | P-20 | 0.4 | AAA | AAA | AAA | AA | AAA | AAA |
| 57 | P-21 | 0.4 | AAA | AAA | AAA | AA | AAA | AAA |
| 58 | P-22 | 0.6 | AAA | AAA | AAA | AA | AA | AA |
| 59 | P-23 | 0.4 | AA | AAA | AA | A | AA | AA |
| 60 | P-24 | 0.4 | AAA | AAA | AAA | AA | AAA | AAA |
| 61 | P-25 | 0.4 | AAA | AAA | AAA | AA | AAA | AA |
| 62 | P-26 | 0.4 | AAA | AAA | AAA | AA | AA | AA |
| 63 | P-27 | 0.4 | AAA | AAA | AAA | AAA | AAA | AAA |
| 64 | P-28 | 0.4 | AAA | AAA | AAA | AAA | AAA | AAA |
| 65 | P-29 | 0.4 | AAA | AAA | AAA | AA | AAA | AAA |
| 66 | P-30 | 0.3 | AAA | AAA | AAA | AA | AAA | AA |
| 67 | P-31 | 0.4 | AAA | AAA | AAA | AAA | AAA | AAA |
| 68 | P-32 | 0.4 | AAA | AAA | AAA | AAA | AAA | AAA |
| 69 | P-33 | 0.5 | AAA | AAA | AAA | AA | AA | AAA |
| 70 | P-34 | 0.4 | AAA | AAA | AAA | AAA | AAA | AAA |
| 71 | P-35 | 0.4 | AAA | AAA | AAA | AAA | AAA | AAA |
| 72 | P-36 | 0.4 | AAA | AAA | AAA | AAA | AAA | AAA |

TABLE 20

| Comparison Example | Kind | Attached amount | Speed of false twisting process: 800 m/minute Fluffs | Yarn breaking | Dyeing property | 1200 m/minute Fluffs | Yarn breaking | Dyeing property |
|---|---|---|---|---|---|---|---|---|
| 29 | R-1 | 0.4 | B | A | B | B | B | B |
| 30 | R-2 | 0.4 | B | A | C | B | B | C |
| 31 | R-3 | 0.4 | C | B | B | C | C | B |
| 32 | R-4 | 0.4 | B | A | B | B | B | B |
| 33 | R-5 | 0.4 | C | B | B | C | C | B |
| 34 | R-6 | 0.4 | C | B | C | C | B | C |
| 35 | R-7 | 0.4 | B | B | B | C | B | B |
| 36 | R-8 | 0.4 | B | A | B | C | B | C |
| 37 | R-9 | 0.4 | B | B | B | C | B | B |
| 38 | R-10 | 0.4 | B | B | B | C | B | B |
| 39 | R-11 | 0.4 | C | B | B | C | B | C |
| 40 | R-12 | 0.4 | B | B | B | C | C | B |
| 41 | R-13 | 0.4 | B | B | C | C | C | C |
| 42 | R-14 | 0.3 | C | C | C | C | C | C |
| 43 | R-15 | 0.4 | B | A | A | C | B | B |
| 44 | R-16 | 0.5 | B | A | A | B | B | B |
| 45 | R-17 | 0.4 | C | B | B | C | C | C |
| 46 | R-18 | 0.4 | B | A | B | C | B | C |
| 47 | R-19 | 0.4 | B | A | C | B | B | C |
| 48 | R-20 | 0.4 | B | A | B | C | B | C |
| 49 | R-21 | 0.4 | B | B | B | C | B | C |
| 50 | R-22 | 0.4 | B | A | B | B | B | B |
| 51 | R-23 | 0.4 | B | A | B | B | B | B |
| 52 | R-24 | 0.4 | C | C | C | C | C | C |
| 53 | R-25 | 0.4 | B | B | C | B | B | C |
| 54 | R-26 | 0.3 | B | A | C | B | B | C |
| 55 | R-27 | 0.4 | B | A | C | B | B | C |
| 56 | R-28 | 0.5 | B | A | B | B | B | B |

In Tables 19 and 20:
Attached amount: Amount (%) that attached to synthetic fibers as processing agent.

What is claimed is:

1. A processing agent for synthetic fibers, said processing agent containing a base oil composition in an amount of 70% by weight or more, said base oil composition including Component A in an amount of 50-90% by weight, Component B in an amount of 3-30% by weight, Component C in an amount of 0.1-10% by weight and Component D in an amount of 0.1-20% by weight such that said Components A-D are contained in a total amount of 100% by weight of said base oil composition;

wherein said Component A is one or more selected from alkyleneoxide addition compounds simultaneously satisfying Conditions 1, 2 and 3 wherein Condition 1 is the condition of having a number average molecular weight of 1000-12000 and having alkylene oxide with 2-4 carbon atoms added to monohydric-trihydric aliphatic alcohol with 1-24 carbon atoms, Condition 2 is the condition of having polyoxyalkylene groups comprising oxyalkylene units of which 10-80% by weight are oxyethylene units, and Condition 3 is the condition of containing 35% by weight or more of alkyleneoxide addition compounds having ethylene oxide and propylene oxide added to monohydric aliphatic alcohol with 6-10 carbon atoms;

wherein Component B is one or more selected from alkylene oxide addition compounds with number average molecular weight of 140-800 having ethylene oxide or both ethylene oxide and propylene oxide to monohydric aliphatic alcohol with 6-10 carbon atoms, having polyoxyalkylene group of which more than 30% by weight of all constituent oxyalkylene units are oxyethylene units;

wherein Component C is one or more selected from ionic surfactants; and wherein Component D is one or more selected from the group consisting of nonionic surfactants having ether bond with number average molecular weight of 210-950 having ethylene oxide and propylene oxide added to monohydric aliphatic alcohol with 11-24 carbon atoms, nonionic surfactants having ether bond with number average molecular weight of 900-2000 having ethylene oxide or propylene oxide added to monohydric aliphatic alcohol with 6-10 carbon atoms, nonionic surfactants having ether bond with number average molecular weight of 150-2500 having ethylene oxide or propylene oxide added to monohydric aliphatic alcohol with 11-24 carbon atoms, nonionic surfactants having ester bond with number average molecular weight of 200-2000 having ethylene oxide and/or propylene oxide added to monohydric aliphatic acid with 8-24 carbon atoms, nonionic surfactants with number average molecular weight of 700-10000 having ethylene oxide and/or propylene oxide added to animal oils and/or vegetable oils, nonionic surfactants having aminoether bond with number average molecular weight of 200-2500 having ethylene oxide and/or propylene oxide added to aliphatic amine with 8-24 carbon atoms, nonionic surfactants having amidoether bond with number average molecular weight of 250-2500 having ethylene oxide and/or propylene oxide added to aliphatic amide with 8-24 carbon atoms, nonionic surfactants having partial ester bond and having dihydric-hexahydric aliphatic alcohol with 2-6 carbon atoms partially esterified with aliphatic acid with 8-24 carbon atoms, and ether-ester nonionic surfactants with number average molecular weight of 400-6000 having ethylene oxide and/or propylene oxide added to partial ester having trihydric-hexahydric aliphatic alcohol with 3-6 carbon atoms partially esterified with aliphatic acid with 8-24 carbon atoms.

2. The processing agent of claim 1 containing said base oil composition in an amount of 80% by weight or more, said base oil composition containing said Component A in an amount of 55-90% by weight, said Component B in an amount of 5-20% by weight, said Component C in an amount of 0.3-5% by weight and said Component D in an amount of 1-20% by weight.

3. The processing agent of claim 2 wherein said Component A contains Component E and Component F in a total amount of 50% by weight or more and at a weight ratio of 50/50-90/10;

wherein said Component E is alkyleneoxide addition compound with number average molecular weight of 1000-12000 and has ethylene oxide and propylene oxide added to monohydric aliphatic alcohol with 6-10 carbon atoms at a weight ratio of 35/65-80/20; and wherein said Component F is alkyleneoxide addition compound with number average molecular weight of 1000-12000 and has ethylene oxide and propylene oxide added to monohydric aliphatic alcohol with 11-16 carbon atoms at a weight ratio of 10/90-80/20.

4. The processing agent of claim 3 further containing 5-40 weight parts of Component G for 100 weight parts of said base oil composition;

wherein said Component G is one or more selected from the group consisting of aliphatic ester compounds shown by $R^1$—X—$R^2$ and aliphatic ester compounds shown by $R^3$-$R^4$ where $R^1$ and $R^3$ are each residual group having hydrogen atom removed from aliphatic monohydric alcohol with 8-18 carbon atoms, $R^2$ is residual group having hydrogen atom removed from aliphatic carboxylic acid with 8-18 carbon atoms, $R^4$ is residual group having hydroxyl group removed from aliphatic carboxylic acid with 8-18 carbon atoms, and X is residual group having all hydroxyl groups removed from (poly)alkyleneglycol having (poly)oxyalkylene group formed with a total of 1-10 oxyethylene units and/or oxypropylene units.

5. The processing agent of claim 3 further containing a total of 0.3-6 weight parts of Component H and/or Component I for 100 weight parts of said base oil composition;

wherein said Component H is polyoxyalkylene modified silicone and/or dimethyl silicone, and wherein said Component I is one or more selected from the group consisting of phenol antioxidants, phosphite antioxidants and thioether antioxidants.

6. The processing agent of claim 4 further containing a total of 0.3-6 weight parts of Component H and/or Component I for 100 weight parts of said base oil composition;

wherein said Component H is polyoxyalkylene modified silicone and/or dimethyl silicone, and wherein said Component I is one or more selected from the group consisting of phenol antioxidants, phosphite antioxidants and thioether antioxidants.

7. The processing agent of claim 6 containing 5-30 weight parts of said Component G, 0.5-3 weight parts of said Component H and 0.5-3 weight parts of said Component I for 100 weight parts of said base oil composition.

8. The processing agent of claim 5 wherein said Component H is polyoxyalkylene modified silicone.

9. The processing agent of claim 5 wherein said Component I is a phenol antioxidant.

10. A method of processing synthetic fibers, said method comprising the step of applying the processing agent of claim 3 at a rate of 0.1-3% by weight of said synthetic fibers.

11. The method of claim 10 wherein the processing agent further contains 5-40 weight parts of Component G for 100 weight parts of said base oil composition; and wherein said Component G is one or more selected from the group consisting of aliphatic ester compounds shown by $R^1$—X—$R^2$ and aliphatic ester compounds shown by $R^3$-$R^4$ where $R^1$ and $R^3$ are each residual group having hydrogen atom removed from aliphatic monohydric alcohol with 8-18 carbon atoms, $R^2$ is residual group having hydrogen atom removed from aliphatic carboxylic acid with 8-18 carbon atoms, $R^4$ is residual group having hydroxyl group removed from aliphatic carboxylic acid with 8-18 carbon atoms, and X is residual group having all hydroxyl groups removed from (poly)alkyleneglycol having (poly)oxyalkylene group formed with a total of 1-10 oxyethylene units and/or oxypropylene units.

12. The method of claim 10 wherein the processing agent further contains a total of 0.3-6 weight parts of Component H and/or Component I for 100 weight parts of said base oil composition:

wherein said Component H is polyoxyalkylene modified silicone and/or dimethyl silicone, and wherein said Component I is one or more selected from the group consisting of phenol antioxidants, phosphite antioxidants and thioether antioxidants.

13. The method of claim 11 wherein the processing agent contains 5-30 weight parts of said Component G, 0.5-3 weight parts of Component H and 0.5-3 weight parts of Component I for 100 weight parts of said base oil composition;

wherein said Component H is polyoxyalkylene modified silicone and/or dimethyl silicone, and wherein said Component I is one or more selected from the group consisting of phenol antioxidants, phosphite antioxidants and thioether antioxidants.

14. The method of claim 10 further comprising the step of preparing an aqueous solution containing said processing agent in an amount of 5-30% by weight, wherein said processing agent is applied as said aqueous solution to said synthetic fibers.

15. The method of claim 14 wherein said processing agent further contains 5-40 weight parts of Component G for 100 weight parts of said base oil composition; and wherein said Component G is one or more selected from the group consisting of aliphatic ester compounds shown by $R^1$—X—$R^2$ and aliphatic ester compounds shown by $R^3$-$R^4$ where $R^1$ and $R^3$ are each residual group having hydrogen atom removed from aliphatic monohydric alcohol with 8-18 carbon atoms, $R^2$ is residual group having hydrogen atom removed from aliphatic carboxylic acid with 8-18 carbon atoms, $R^4$ is residual group having hydroxyl group removed from aliphatic carboxylic acid with 8-18 carbon atoms, and X is residual group having all hydroxyl groups removed from (poly)alkyleneglycol having (poly)oxyalkylene group formed with a total of 1-10 oxyethylene units and/or oxypropylene units.

16. The method of claim 14 wherein said processing agent further contains a total of 0.3-6 weight parts of Component H and/or Component I for 100 weight parts of said base oil composition;

wherein said Component H is polyoxyalkylene modified silicone and/or dimethyl silicone, and wherein said Component I is one or more selected from the group consisting of phenol antioxidants, phosphite antioxidants and thioether antioxidants.

17. The method of claim 15 wherein said processing agent contains 5-30 weight parts of said Component G, 0.5-3 weight parts of Component H and 0.5-3 weight parts of Component I for 100 weight parts of said base oil composition;

wherein said Component H is polyoxyalkylene modified silicone and/or dimethyl silicone, and wherein said Component I is one or more selected from the group consisting of phenol antioxidants, phosphite antioxidants and thioether antioxidants.

* * * * *